United States Patent [19]
Cemenska
[11] 4,318,333
[45] Mar. 9, 1982

[54] BIDIRECTIONAL, MULTIPLE SPEED HYDRAULIC ACTUATOR

[75] Inventor: Richard A. Cemenska, Edelstein, Ill.
[73] Assignee: Caterpillar Tractor Co., Peoria, Ill.

[21] Appl. No.: 99,138
[22] PCT Filed: Sep. 28, 1979
[86] PCT No.: PCT/US79/00798
§ 371 Date: Sep. 28, 1979
§ 102(e) Date: Sep. 28, 1979
[87] PCT Pub. No.: WO81/00893
PCT Pub. Date: Apr. 2, 1981
[51] Int. Cl.[3] ..... F15B 13/04; F15B 15/17
[52] U.S. Cl. ..... 91/31; 91/32; 91/415; 91/416; 91/417 R; 137/625.68
[58] Field of Search ..... 91/31, 32, 362, 415, 91/416, 417; 137/625.35, 625.68, 625.69

[56] References Cited

U.S. PATENT DOCUMENTS

| | | | |
|---|---|---|---|
| Re. 25,882 | 10/1965 | Bower | 91/31 |
| 2,604,075 | 7/1952 | Naud | 91/362 X |
| 2,612,184 | 9/1952 | Evans | 91/31 X |
| 2,674,850 | 4/1954 | Svenson et al. | 91/31 X |
| 2,843,093 | 7/1958 | Vltavsky | 137/625.64 |
| 2,855,752 | 10/1958 | Brusque | 91/24 |
| 2,986,124 | 5/1961 | Allemann | 91/39 X |
| 3,094,173 | 6/1963 | Hausmann et al. | 91/31 X |
| 3,472,281 | 10/1969 | Chiba et al. | 137/625.69 |
| 3,604,884 | 9/1971 | Olsson | 91/404 X |

*Primary Examiner*—Irwin C. Cohen
*Attorney, Agent, or Firm*—Wegner, Stellman, McCord, Wiles & Wood

[57] ABSTRACT

A bidirectional, multiple speed hydraulic actuator, including a differential piston (10, 24, 26). First and second ports (28, 30) are respectively in fluid communication with opposite sides of the piston and there is provided a pressure fluid supply line (40) along with a pressure fluid drain line (44). A control valve (14) is disposed between the ports and the lines and is movable step-wise through five positions providing for nulling of piston movement, and slow and rapid piston movement in either of two directions. A shifting device (60) is provided for the valve.

10 Claims, 5 Drawing Figures

INDICATOR
FEEDBACK
CONTROL
COMMAND
MECHANISM

BIDIRECTIONAL, MULTIPLE SPEED HYDRAULIC ACTUATOR

DESCRIPTION

1. Technical Field

This invention relates to a bidirectional, multiple speed, hydraulic actuator as may be used in, for example, the driving of racks in fuel injection systems, transmission controls, steering mechanisms such as ship rudders, etc.

2. Background Art

A large variety of applications require the use of a bidirectional, multiple speed actuators. And, in a large number of cases, it is desirable that the actuators be of the hydraulic variety.

Typical of the uses for such actuators are fuel injection systems for internal combustion engines of the types employing so-called unit injectors wherein movement of a rack increases or decreases the quantity of fuel injected into a cylinder to change engine speed as well as controls the point in the engine operating cycle whereat injection occurs. Other applications include the positioning of a rudder on a ship or a boat.

In applications such as those mentioned, there frequently exists a need for a rapid change in response to the existence of a large difference or error between a commanded condition and the actual condition that is occuring as well as a slow response for relatively small differences or errors which facilitate precise positioning of the mechanism being driven by the actuator.

Many systems are available to meet these needs but virtually all known to date operate on an analog principle and therefore produce signals and motions of magnitudes proportional to the deviation or error from the desired operating condition. They do not operate on a digital principle which facilitates ultimate control by digital electronics.

An attempt has been made to provide a bidirectional, multiple speed hydraulic actuator operating on a digital principle. A large number of components has heretofore been required. Consequently, reliability is somewhat suspect.

DISCLOSURE OF THE INVENTION

The present invention is directed to overcoming one or more of the problems as set forth above.

According to the present invention, there is provided a bidirectional, hydraulic actuator operating on the digital principle and having but three components, a piston, a single control valve, and a device for operating the control valve. The piston is a differential piston and by reason of the valve being positioned step-wise in a digital fashion, fluid flow to either or both the larger and the smaller piston surfaces, and the rate of such flow, from a supply a line, and flow to a drain is controlled to provide an actuator with a minimum number of moving parts subject to failure and which is ideally suited for ultimate control by electronic control systems.

BEST MODE FOR CARRYING OUT THE INVENTION

Figure 1:
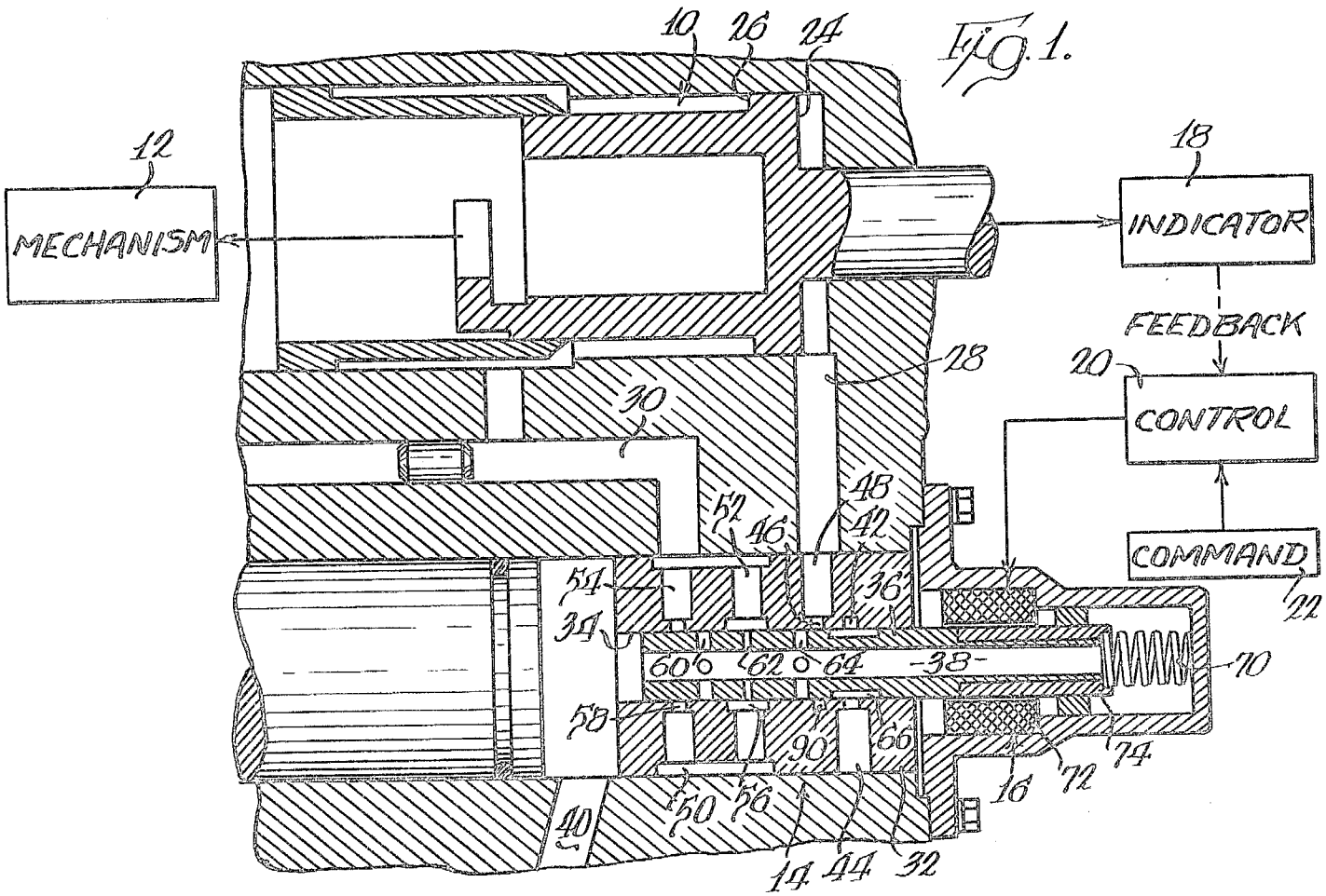
FIG. 1 is a partial sectional, partial schematic view of the actuator of the present invention with the components in a null condition.

An exemplary embodiment of a bidirectional, multiple speed hydraulic actuator made according to the invention is illustrated in FIG. 1 and is seen to be comprised of three main parts. The first is a piston, generally designated 10, which may be connected in any suitable fashion to a mechanism 12 to be driven thereby. The mechanism may be a rack in a fuel injection system, some portion of a transmission, a steering component or the like. The second component is a valve, generally designated 14, which is employed to control the flow of fluid to and from the piston 10.

The third component is a means, generally designated 16, for shifting the valve 14 in a step-wise fashion to establish desired flow paths through the valve. In some cases, the shifting means 16 may be controlled directly by an operator of the mechanism 12 without more but it is also contemplated that the shifting means 16 be controlled by a servo system of the digital electronic type. In such a case, the piston 10 may be connected to an indicator 18 which provides a feedback signal indicative of the actual position of the piston 10 and the mechanism 12 controlled thereby. This signal is fed to a control system 20 which compares the actual position information with a desired or commanded position information signal provided by a command or input device 22 which could be operated by the operator of the mechanism 12 or by a computer or the like.

Returning to the piston 10, the same includes first and second pressure responsive surfaces 24 and 26, respectively, in opposed relation. The surface 24 has twice the surface area of the surface 26 forming a differential piston. The precise ratio of the size of the two surface areas 24 and 26 forms no part of the present invention as it may be varied to suit any particular application. However, when a 2:1 ratio is employed, as will become apparent, rate of movement of the piston 10 in either direction will be the same at both high speed and low speed conditions.

A first port 28 is in fluid communication with the surface 24 while a second port 30 is in fluid communication with the surface 26. The ports 28 and 30 extend to a valve body 32 forming part of the valve 14. The valve body 32 includes a central bore 34 which reciprocally receives a spool 36. The spool 36 includes a hollor center 38 extending from end to end and which is in constant fluid communication with a supply line 40 from which pressurized hydraulic fluid, preferably at constant pressure, may be received.

Near the right hand end of the body 32 as viewed in FIG. 1, the bore 34 includes annulus 42 which is in fluid communication with a drain line 44 which may extend to the system reservoir (not shown). Just to the left of the annulus 42 is an annulus 46 connected to a port 48 aligned with the port 28. Thus, any fluid passing to or from the first port 28, and thus to the larger surface 24, must pass through the annulus 46.

The valve body 32 includes an exterior annulus 50 near its left hand end as view in FIG. 1 which is in fluid communication with the port 30. From the annulus 50, axially spaced, radially inwardly directed ports 52 and 54 extend to terminate in annuli 56 and 58 on the bore 34. As can be seen the annulus 56 is relatively wide, that is, has a relatively long axial length whereas the annulus 58 is rather narrow. Consequently, there are two connections of the port 30 to the bore 34 which are axially spaced from each other.

The spool 36 is provided with, from left to right as viewed in FIG. 1, three sets of drilled cross bores 60,62, and 64 extending from the hollow center 38 to the exterior of the spool 36. The cross bores 60 62 and 64 establish fluid communication between the center 38 of the spool 36 and various ones of the annuli 46,56 and 58. The cross bores 60 and 64 have large diameters so as to allow substantially unrestricted fluid flow therethrough while the cross bore 62 has a small diameter so as to restrict the flow of fluid therethrough.

The exterior surface of the spool 36 is also provided with a shallow groove 66 which may be employed, as will be seen, to establish fluid communication between the annulus 46 and the annulus 42 to the drain line 44. The remainder of the exterior surface of the spool forms a plurality of blocking surfaces for blocking one or more of the various annuli as will be apparent to those skilled in the art.

It will be observed from FIG. 1 that opposite ends of the spool 36 are of the same internal and external diameters with the consequence that the presence of fluid at supply pressure will result in equal forces being applied to both ends of the spool 36 to force balance the same. In some instances, a small spring 70 may be employed to provide a slight biasing force to the spool in one direction to drive the spool 36 to a predetermined position in the event of failure of the actuator 16.

In the embodiment illustrated, the actuator 16 is a proportional solenoid having a winding 72. In such a case, the major part of the spool 36 is formed of a magnetic material so as to act as the armature of the solenoid. For the particular construction shown, the right hand end of the spool 36 is provided with an outer-sleeve 74 of nonmagnetic material so as to enable the winding 72 to drive the spool 36 to the right as seen in FIG. 1.

Other shifting devices can be used other than a solenoid, including, if desired, a mechanical linkage; but as will be apparent, it is desirable that the spool 36 be shifted in a step-wise fashion, that is, through discrete positions corresponding to digital inputs. In other words, the invention does not contemplate infinitely variable positioning of the spool 36 as would cause modulation of the flow of fluid at the spool-body interface.

Before proceeding to a discussion of the industrial applicability of the invention, it should be observed that while the preferred embodiment has been shown and described as including a reciprocal piston 10, a rotary piston could be employed as well. Similarly, while a spool valve employing a spool reciprocal within a bore has been described as comprising the valve 14, a rotary valve could likewise be employed utilizing the principles of the invention.

Industrial Applicability

As viewed in FIG. 1, the components of the valve 14 are oriented in a position, in response to suitable control inputs to the shifting means 16, to command a null actuator condition, that is, no movement of the piston 10. Such a null can be achieved irrespective of the position of the piston 10 along its path of movement. In this condition, supply fluid under pressure from the line 40 will be applied to the smaller piston surface 26 via the cross bore 62 and the port 30. However, as can be seen, a land 90 on the exterior of the spool 36 and located between the annulus 66 and the cross bore 64 is blocking the annulus 46 precluding the flow of fluid from the first bore 28. Thus, there is a trapped column of hydraulic fluid bearing against the surface 24 of the piston 10 precluding the same from moving.

Figure 2:
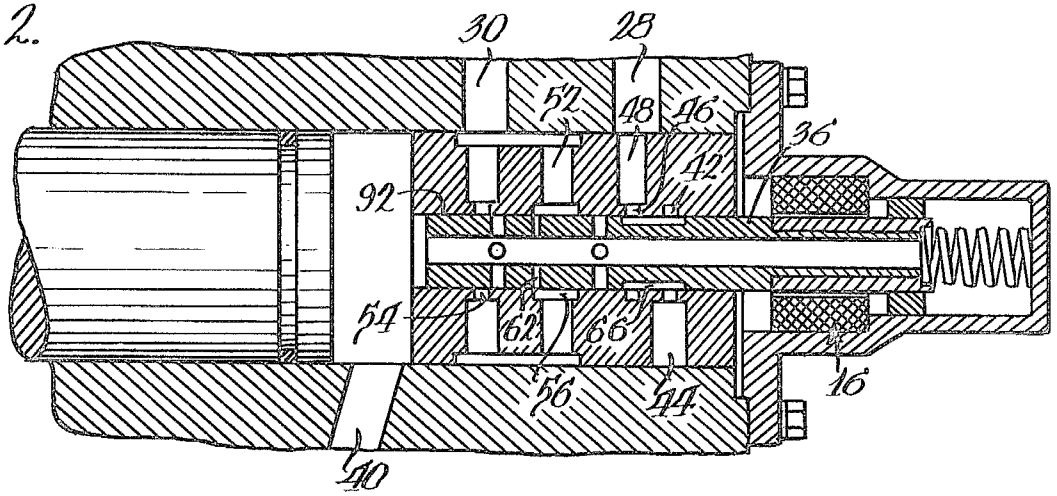
FIG. 2 is a fragmentary sectional view of the control valve of the actuator positioned to command slow movement of the actuator output in one direction.

Assuming a small error has been detected and relatively slow movement of the piston 10 to the right as viewed in FIG. 1 is desired to correct for the error, the shifting means 16 is directed to move the spool 36 slightly to the left of the position illustrated in FIG. 1. The new position is illustrated in FIG. 2 and as can be seen, fluid communication from the first port 28 to the drain line 44 is established via the annulus 46, the groove 66 and the annulus 42. The formerly trapped column of fluid against the surface 24 no longer exists.

At the same time, fluid from the supply line 40 may continue to be directed against the surface 26 of the piston 10 via the small cross bore 62 in the spool 36, the annulus 56, the port 52 and the port 30. At this time, a land 92 on the left hand end of the spool 36 continues to block the annulus 54. Consequently, the supply of pressure fluid to the surface 26 can only follow the path including the small cross bore 62 which, by reason of its small size, restricts the flow of such fluid. A pressure drop will exist with the consequence that a pressure less than full supply pressure will be applied to the surface 26 causing slow movement of the piston 10 to the right.

Figure 3:
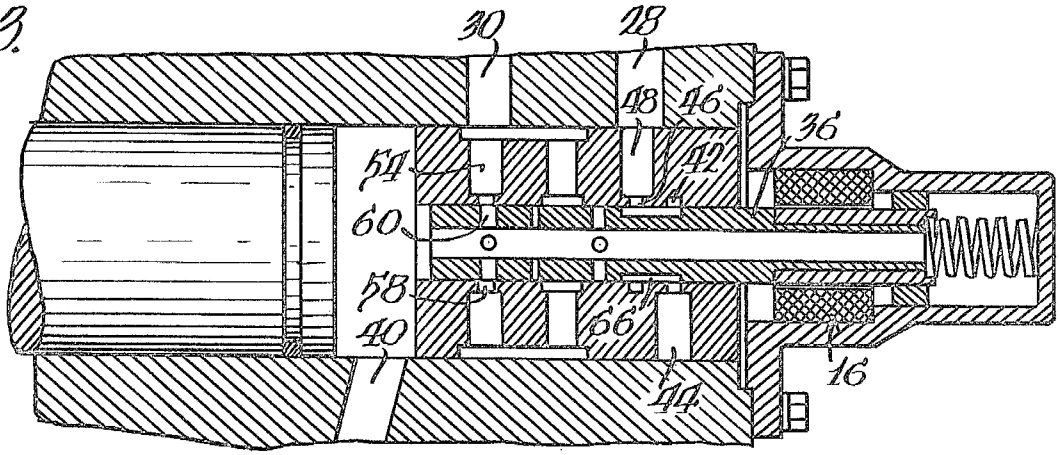
FIG. 3 is a view similar to FIG. 2 but showing the valve configured to produce rapid movement of the actuator output in the same direction.

When a large error requiring rapid correction and thus rapid movement of the piston 10 occurs, the shifting means 16 shifts the spool 36 further to the left to the position shown in FIG. 3. In this position, the surface 24 remains connected to the drain line 44 via the port 28, the port 48, the annulus 46, the groove 66, and the annulus 42. The shifting of the spool 36 to the left has now brought the large cross bore 60 into fluid communication with the annulus 58 so that fluid from the supply line 40 may flow, substantially unrestricted, through the cross bore 60, the annulus 58, the port 54 and the port 30 to the surface 26. Since there is no substantial restriction on flow, there will be very little pressure drop and substantially full supply line pressure will be applied to the surface 26 resulting in rapid movement of the piston 10 to the right.

Figure 4:
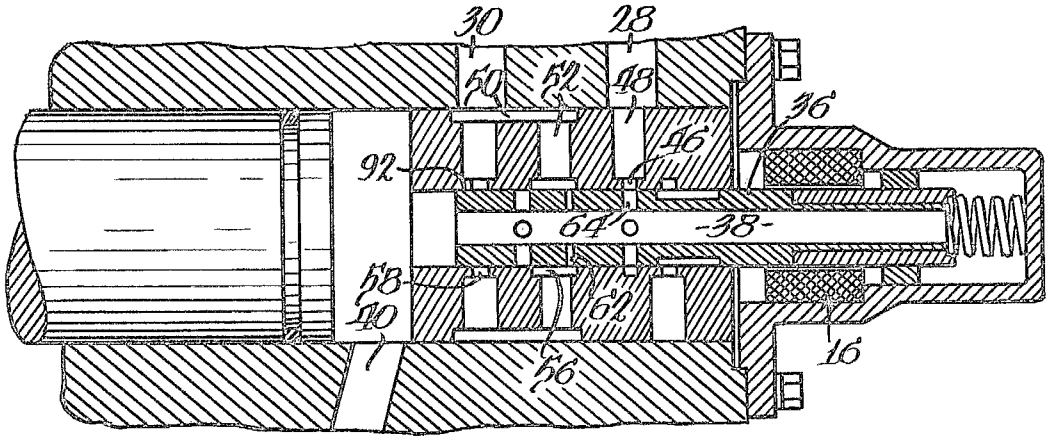
FIG. 4 is a view similar to FIGS. 2 and 3, but showing the components configured to produce slow movement of the actuator output in the opposed direction.

When a small error requiring movement of the piston 10 to the left at a relatively slow rate occurs, the shifting means 16 is directed to move the spool to the right from the position illustrated in FIG. 1 to the position illustrated in FIG. 4. When this occurs, the large cross bore 64 is brought into fluid communication with the annulus 46 to thereby direct fluid from the supply line 40 to the large piston surface 24 via the port 48 and the port 28. Because the flow is through a large cross bore as the large cross bore 64, it will be unrestricted and substantially full supply line pressure will be applied to the large surface 24. At the same time, the annulus 58 will be blocked by the land 92 but fluid flow from the smaller piston surface 26 will be permitted via the port 30, the annulus 50, the port 52, the annulus 56 and the small cross bore 62 to the interior 38 of the spool 36. This fluid flow will be restricted by reason of the small size of the cross bore 62. Since supply pressure will be present at the center 38 of the spool 36, and a pressure drop must occur across the small cross bore 62, a pressure higher than supply pressure will exit upstream of the cross bore 62 and against the small surface 26 of the piston 10. This high pressure acting against the surface 26 will resist piston movement to the left. But because the surface 24 is larger than the surface 26, a greater total force will be applied against the surface 24 causing slow movement of the piston 10 to the left.

Figure 5:
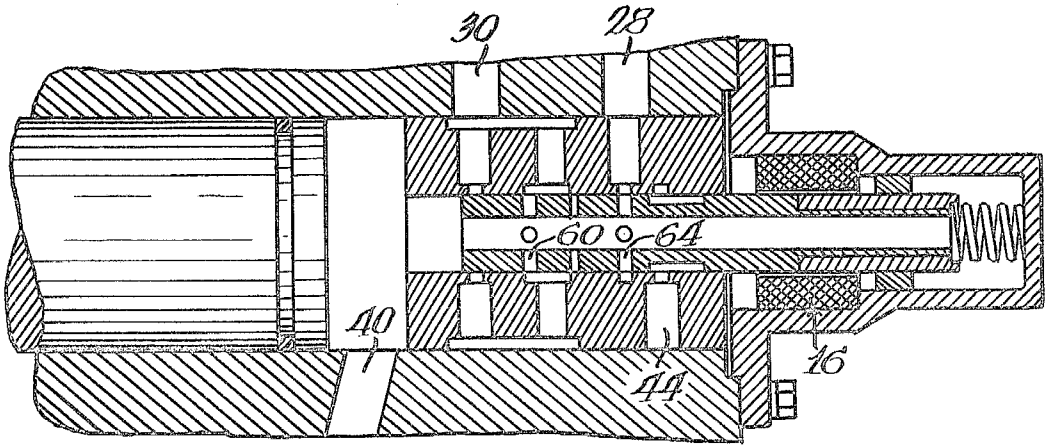
FIG. 5 is a view similar to those of FIGS. 2-4, but showing the components configured to produce rapid movement of the actuator in the same direction as it would move for the configuration shown in FIG. 4.

When rapid leftward movement of the piston 10 is called for, the shifting means 16 shifts the spool further to the right to the position illustrated in FIG. 5. In this case, supply pressure will be applied to both of the surfaces 24 and 26 as the large cross bore 64 has been moved in fluid communication with the port 28 and the large cross bore 60 has been moved into fluid communication with the port 30. Unlike the condition illustrated in FIG. 4, there are now equal pressures applied to both sides of the piston 10 and since the surface 24 is larger than the surface 26, a greater force will be placed thereon. A lesser force will be existing on the surface 26 than in the case shown in FIG. 4 because of the reduced pressure thereat. Consequently, rapid movement of the piston 10 to the left will occur.

From the foregoing, it will be seen that the invention provides a bidirectional, multiple speed, hydraulic actuator acting on step-wise, i.e. digital, inputs. Essentially, only two moving parts are employed, namely, the piston 10 and the valve spool 36. Even considering the shifting means 16 as an additional component, it will be appreciated that there are only three major components to the entire actuator.

And while the invention has been described in connection with an actuator providing five conditions including null and two differing speeds in each direction, those skilled in the art will recognize the applicability of the principles of the invention to an actuator providing a greater number of speeds simply providing additional degrees of fluid flow restriction such as providing additional orifices which can be either larger or smaller than the cross bores 60,62, and 64 illustrated.

Therefore, it will be readily understood that a hydraulic actuator made according to the invention is ideally suited for ultimate control by digital electronics and has high reliability by reason of the minimal number of the components employed.

I claim:

1. A bidirectional, multiple speed hydraulic actuator comprising:

a piston (10) adapted to be connected to an apparatus to be driven bidirectionally at at least two differing speeds in each direction, said piston having opposed pressure responsive surfaces (24,26), one (24) being larger than the other (26);

first and second parts (28,30) respectively in fluid communication with said one and said other surfaces;

a pressure fluid supply line (40);

a pressure fluid drain line (44);

a control valve (14,32,36) between said ports (28,30) and said lines (40,44) and having a movable valve member (36) defining an internal flow chamber (38) and radial ports (60,62,64) opening outwardly from said flow chamber, and a valve body (32) movably receiving said valve member (36) and defining passages (48,52,54) providing selective communication between said radial ports (60,62,64) of the movable valve member (36) and said first and second ports (28,30) as an incident of movement of said movable valve member (36) to preselected positions;

(a) blocking flow to and/or from one of said ports (28) to prevent movement of said piston, (b) establishing flow from said one port (28) to said drain line (44) and restricted flow from said supply line (40) to said other port (30) to produce slow movement of said piston in one direction, (c) establishing flow from said one port (28) to said drain line (44) and unrestricted flow from said supply line (40) to said other port (30) to produce rapid movement of said piston in said one direction, (d) establishing unrestricted flow to said one port (28) from said supply line and restricted flow from said other port (30) to said supply line (40) to produce slow movement of said piston in the other direction, and (e) establishing fluid communication between both said ports (28,30) and said supply line (40) to produce rapid movement of said piston in said other directions; and a single device (16) for moving said valve selectively fully to said preselected positions.

2. The bidirectional, multiple speed hydraulic actuator of claim 1 wherein said restricted flows are produced by directing fluid thru relatively small conduits (62), said conduits being in at least one of said valve member and said body.

3. The bidirectional, multiple speed hydraulic actuator of claim 2 wherein said conduits comprise a number of the radial ports (60,62,64) of said valve member.

4. The bidirectional multiple speed hydraulic actuator of claim 3 wherein said valve member is a spool (36) having opposed ends of equal size in fluid communication with said supply line.

5. The bidirectional multiple speed hydraulic actuator of claim 4 wherein said spool is hollow (38) end to end.

6. A bidirectional, multiple speed hydraulic actuator comprising:

a piston (10) adapted to be connected to an apparatus to be driven hydraulically at at least two differing speeds in each direction, said piston having opposed pressure responsive surfaces (24,26), one (24) being larger than the other (26);

first and second ports (28,30) respectively in fluid communication with said one and said other surfaces;

a pressure fluid supply line (40);

a pressure fluid drain line (44);

a single control valve (14) including a valve body (32) with a valve member (36) movable therein, said valve body having spaced connections (42,46,48,52,54,56,58) to said lines and to said ports, there being two spaced connections (52,54,56,58) to said second port, said valve member having blocking surfaces (90,92) for blocking selected ones of said connections and an interior inlet chamber (38) open to flow passages (60,62,64,66), said flow passages allowing flow between selected ones of said connections dependent upon the relative position of the valve member within the valve body;

one of said blocking surfaces (90), for one valve member position, halting fluid flow from at least one of said ports (28) to prevent movement of said piston;

two of said flow passages (60,64) being large passages and another (62) being a small passage, and for a second valve member position, an additional one of said passages (66) connecting said one port with said drain line while said small passage connects said supply line to a first connection (52,56) to said second port with another of said blocking surfaces (92) blocking the second connection (54,58) to said second port so that said piston will move slowly in one direction;

one of said large passages (60) for a third valve member position, establishing flow from said supply line to said second connection (54,58) to said second port with said additional passage (66) establishing flow between said one port and said drain line to produce rapid piston movement in said one direction;

the other of said large passages (64), for a fourth position of said valve member, establishing flow between said one port and said supply line while said small passage (62) establishes flow between said second port first connection (52,56) and said another blocking surface (92) blocks said second port second connection to produce slow piston movement in the other direction;

said large passages (60,64) for a fifth position of said valve member establishing flow between said supply line and both of said ports to produce rapid piston movement in said other direction; and means for moving said valve member (36) selectively fully to said five positions.

7. The bidirectional, multiple speed hydraulic actuator of claim 6 wherein said valve member is a hollow spool (36,38) having its interior inlet chamber in fluid communication with said supply line and wherein said connections open to a bore (34) in said body receiving said spool in axially spaced relation with said second port first connection (52,56) being disposed between said first port connection (46,48) and said second port second connection (54,58), said large and small passages (60,62,64) extending generally radially from the interior inlet chamber of the spool to the exterior thereof with said small passage (62) being flanked, in axially spaced relation, by said large passages (60,64).

8. The bidirectional, multiple speed hydraulic actuator of claim 1 wherein said control valve constitutes a single spool valve (36).

9. In a bidirectional, multiple speed hydraulic actuator of the type including a piston (10) having opposed pressure responsive surfaces (24,26), one (24) being larger than the other (26), first and second ports (28,30) respectively in fluid communication with said one (24) and said other (26) surfaces, a pressure fluid supply line (40), and a drain line (44), the improvement comprising:

control valve means (14,32,36) for controllably blocking said drain line (44) and connecting said supply line (40) and said drain line (44) to said ports (28,30) and selectively preventing movement of said piston (10), producing a preselected slow rate of movement of said piston (10) in either direction, and producing a preselected fast rate of movement of said piston (10) in either direction, said control valve means (14,32,36) including a single valve spool member (36) having an internal inlet flow chamber (38) open to radial ports (60,62,64), said radial ports being positionable selectively in five positions corresponding to operating conditions; and means (16) for moving said valve spool member (36) selectively fully to said five positions.

10. The actuator of claim 9 wherein said means (16) is operated by a servo system of the digital electronic type.

* * * * *